US005183199A

United States Patent [19]

Bills

[11] Patent Number: 5,183,199

[45] Date of Patent: Feb. 2, 1993

[54] CONTAINER DEVICE AND METHOD FOR MAKING SAME

[76] Inventor: Maria L. Bills, 3368 S. Parnell, Chicago, Ill. 60616

[21] Appl. No.: 823,754

[22] Filed: Jan. 22, 1992

[51] Int. Cl.[5] ..... B65D 3/00

[52] U.S. Cl. ..... 229/23 A; 229/40; 229/122; 229/125.38; 229/125.41; 493/84

[58] Field of Search ..... 229/23 A, 23 R, 40, 229/125.22, 121, 122, 125.37, 125.38, 125.39, 125.41; 493/84; 220/DIG. 25

[56] References Cited

U.S. PATENT DOCUMENTS

| | | | |
|---|---|---|---|
| 604,228 | 5/1898 | Claff . | |
| 963,318 | 7/1910 | Nack . | |
| 1,058,777 | 4/1913 | Mitchell | 229/23 A |
| 1,140,765 | 5/1915 | Payne | 229/23 A |
| 1,155,686 | 10/1915 | Burke . | |
| 1,473,942 | 11/1923 | Strauss | 229/125.22 |
| 1,922,354 | 8/1933 | Rhodes . | |
| 2,260,951 | 10/1941 | Mulnix | 229/117.26 |
| 2,320,396 | 6/1943 | Ringler | 229/23 A |
| 3,027,060 | 3/1962 | Beder | 229/8 |
| 3,622,063 | 11/1971 | McVeigh | 229/23 R |
| 4,101,052 | 7/1978 | Dove | 229/125.22 |
| 4,607,784 | 8/1986 | Calabrese | 229/125.38 |

FOREIGN PATENT DOCUMENTS

| | | | |
|---|---|---|---|
| 1581 | 10/1916 | Netherlands | 229/23 A |

*Primary Examiner*—Allan N. Shoap
*Assistant Examiner*—Christopher J. McDonald
*Attorney, Agent, or Firm*—Welsh & Katz, Ltd.

[57] ABSTRACT

A container includes a sleeve-like member having a plurality of interconnected wall panel panels defining an interior storage cavity having two open ends. A foldable insert member is adapted to be inserted through the storage cavity from at least one of the open ends and is foldably divided into a primary support panel and a plurality of inwardly foldable end flaps. The support panel is interposed between the foldable end flaps and adapted to lie against a selected wall panel. Contents are inserted into the storage cavity from either open end and the end flaps are folded to substantially cover the open ends. The end flaps are then secured over the two open ends to form a substantially closed enclosure about the storage cavity.

17 Claims, 2 Drawing Sheets

CONTAINER DEVICE AND METHOD FOR MAKING SAME

FIELD OF INVENTION

This invention relates generally to container devices for packaging items, and more particularly to a novel container device and method for making same which finds particular application as a reusable decorative container.

BACKGROUND OF THE INVENTION

One type of container for packaging gifts includes a paper shopping bag with decorative exterior surfaces. However, these decorative paper shopping bags generally offer little protection for the contents against damage from external forces.

Another type of container for packaging gifts includes a decorative cardboard box and cover having decorative exterior surfaces. A tying ribbon is then applied to secure the cover to the box. Yet another more traditional gift packaging container includes a cardboard box and cover subsequently wrapped in decorative wrapping paper and tying ribbon.

The decorative cardboard box and cover with tying ribbon helps to eliminate the need for using colorful gift wrap paper since the decorative exterior surface is an integral part of the box and cover. These types of containers are typically made from two cardboard blanks having colorful gloss finishes. However, fabrication and assembly of these containers becomes more complex given that both the box and cover are typically five-sided pieces. This structure generally necessitates extensive folding and gluing procedures for proper assembly.

Furthermore, the assembled box generally has only one opening for inserting or removing the contents, similar to the traditional container. This restricts accessibility to the storage cavity inside the container. A problem arises when the contents are bulky or fit tightly into the storage cavity. Little room may be left for fingers or other gripping devices for inserting or removing the contents. Consequently, damage to the box and/or cover or contents may result.

The traditional container typically has the additional problems of waste and time consuming assembly. The wrapping process generally becomes tedious and requires an inordinate amount of time given the cutting, wrapping, and taping processes typically involved. Waste results during both the initial wrapping process and the subsequent opening process. Cutting and wrapping from standard sized roles of wrapping paper often results in unused oddly shaped pieces of wrapping paper which are subsequently discarded. During the opening process, the wrapping paper and/or box is generally rendered non-reusable after being torn or otherwise damaged by a recipient.

Several other types of containers are known such as cardboard folding boxes having intricate ribbon pull systems that telescopically unite the sides of the box. Other folding boxes secure sides together by tying a ribbon that has been interwoven in the sides through a plurality of channels or slits. These folding boxes result in increased manufacturing costs due to relatively complex fabrication techniques required since the ribbon must be intricately fed through the channels or slits in the sides of the box to facilitate closure.

Accordingly, there exists a need for a container that reduces the time for assembly while affording manufacturing cost savings. A need also exists for a container that facilitates improved access to the inside of the container thereby reducing damage to the contents and/or the container when used. Furthermore there exists a need for a reusable container suitable for application as a packaging container for gifts. These needs and others are substantially met through the container device and method for making the same described below.

SUMMARY OF THE INVENTION

In carrying out the present invention, a container device is provided which includes a sleeve-like member and a foldable insert member. The sleeve-like member has a plurality of interconnected wall panels defining an interior storage cavity having two opposite open ends. The foldable insert member is adapted to be inserted through the storage cavity from at least one of the open ends and is foldably divided into a support panel and a plurality of foldable end flaps. The support panel is interposed between the foldable end flaps and is adapted to lie against a selected wall panel. The end flaps are foldable to substantially cover the open ends. A securing mechanism is coupled to the foldable insert member for securing the end flaps over the two open ends to form a substantially closed enclosure about the storage cavity.

The method for making the container includes inserting the foldable insert member through the sleeve-like member from either of the two open ends of the storage cavity such that the foldable insert member is proximate an inside surface of one of the interconnected wall panels. Contents to be packaged are inserted into the storage cavity through one of the open ends. The plurality of end flaps are folded over the two open ends and secured over the two open ends using the securing mechanism.

The various advantages and features of the container device in accordance with the present invention will become apparent from the following detailed description taken in conjunction with the accompanying drawings.

DETAILED DESCRIPTION OF THE PREFERRED EMBODIMENTS

Generally, containers for packaging items can be of many types and may be dimensioned to accommodate variations in the size and/or nature of the contents. It will be understood that although the previous discussion was primarily directed to containers suitable for packaging items such as gifts, the inventive container device may be readily usable for packaging other items.

Figure 1:
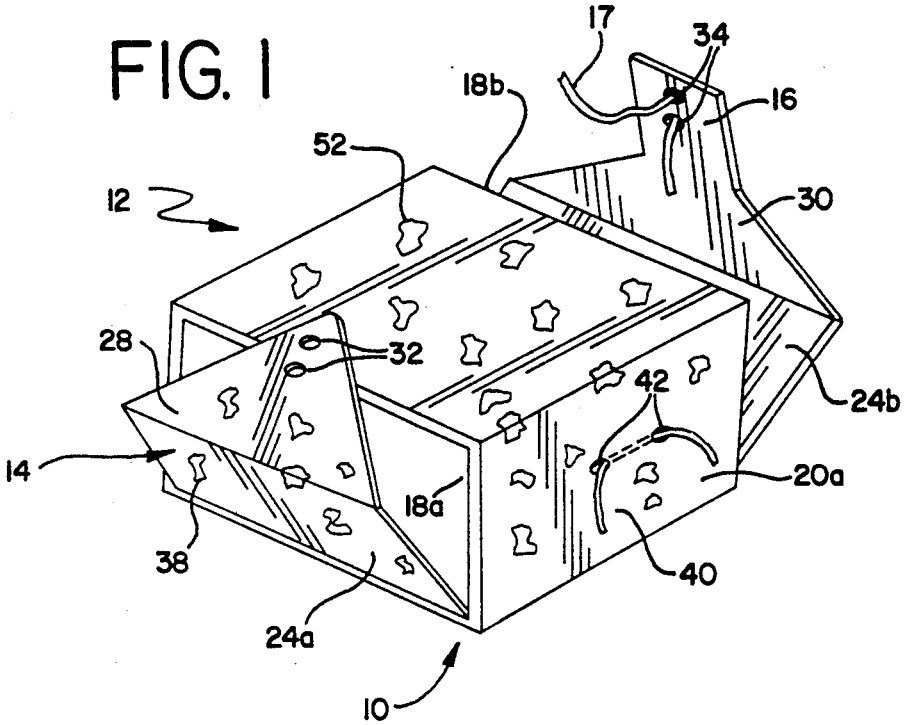
FIG. 1 is a perspective view depicting a partially assembled container constructed in accordance with one embodiment of the invention.

FIG. 1 illustrates a partially assembled container device 10 which includes a decorative open-ended sleeve-like member 12 having two opposite open ends, a foldable insert member 14 such as a decorative cardboard strip, and a securing mechanism 16.

Figure 2:
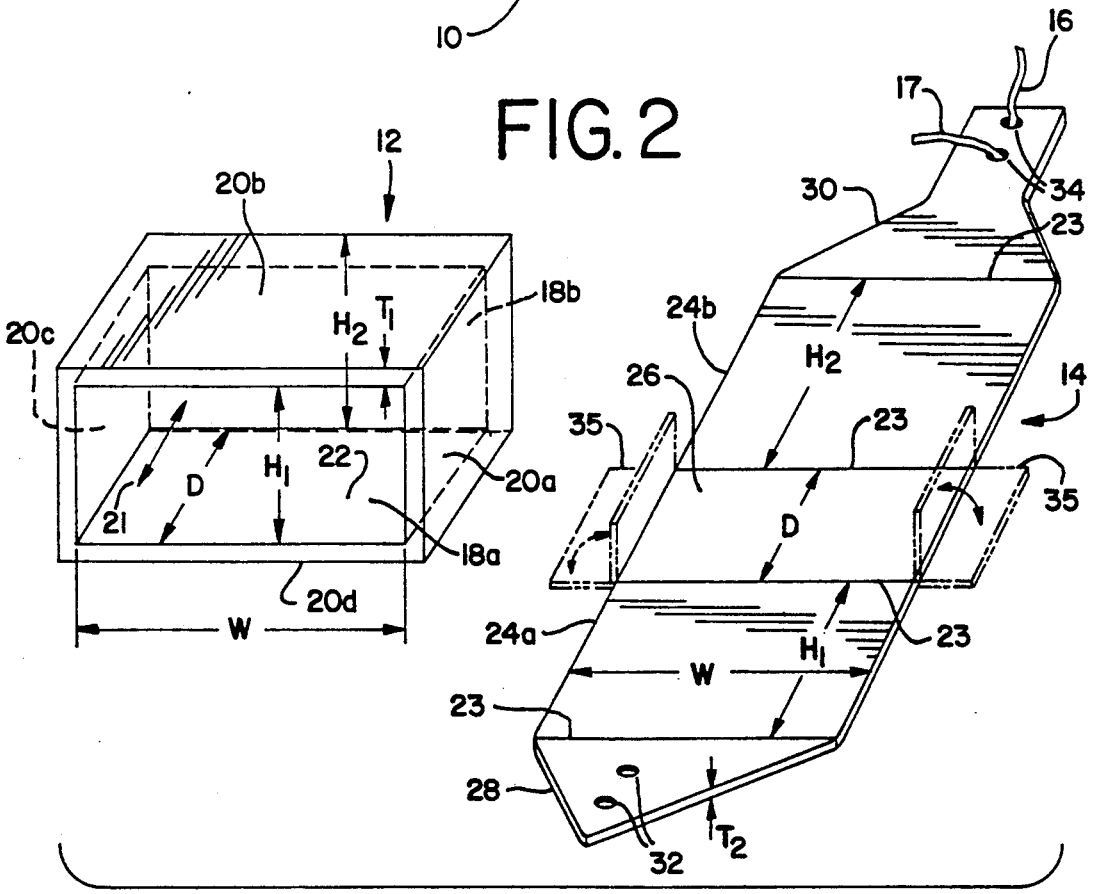
FIG. 2 is a perspective view of the sleeve-like member and the foldable insert member employed in the container device of FIG. 1.

Referring to FIGS. 1 and 2, the sleeve member 12 is generally rectangular in transverse cross-section and has an open front end 18*a* and an open rear end 18*b*. The sleeve member 12 includes a first side wall panel 20*a*, a top wall panel 20*b*, a second side wall panel 20*c*, and a bottom wall panel 20*d*, which are mutually interconnected along their marginal edges through longitudinal right-angle folds. The various wall panels are substantially planar and form storage cavity or compartment 21 which extends the full length of the sleeve member 12 between the open ends 18*a* and 18*b*. Each of the adjacent wall panels is of equal thickness T1 and is typically made from cardboard although plastic or other suitable material may be used.

The open front-end 18*a* has a height H1 (including the thickness of the top side 20*b*) and an inside width W. The open rear end 18*b* has a height H2 (including the thickness of the top side 20*b*) and also has the inside width W. The bottom wall panel 20*d* has a depth D and inside width W. The bottom wall panel 20*d* has inside surface 22 on which the foldable insert 14 rests. The sleeve member 12 may be formed from a single blank of cardboard folded about fold lines corresponding to the right-angle corners of the sleeve member.

Although the preferred embodiment discloses a substantially rectangular open-ended member 12, other suitable shapes may also be used such as tubular, hexagonal or "L"-shaped members. It will be understood that the terms "bottom wall panel" or "top wall panel" are for purposes of description only to more clearly describe the member 12 in its depicted orientation.

Foldable insert member 14 is typically a unitary cardboard member divided into a plurality of adjacent foldable sections along transverse fold lines 23. The foldable insert 14 includes a rectangular front end flap 24*a*, a rectangular rear end flap 24*b*, a rectangular support panel 26, interposed between the front and rear end flaps 24*a* and 24*b*, a triangular foldable front attachment tab 28 and a foldable rear attachment tab 30 located at distal ends of the foldable insert member. The foldable insert member 14, has a transverse width W substantially equal to the inside width W of the sleeve member 12 and a thickness T2 which may be generally equal to thickness T1 of the blank from which sleeve member 12 is made.

The foldable front end flap 24*a* has a longitudinal length H1 and transverse width W such that it generally corresponds dimensionally to the shape and area of the rectangular open end 18*a* of sleeve member 12. In this manner, the end flap 24*a* serves as a closure to the open end 18*a* of the open ended sleeve member 12. Similarly, foldable end flap 24*b* has a longitudinal length H2 corresponding generally to the height of the open end 18*b* of sleeve member 12 such that the end flap 24*b* can serve as a closure for the rear end of the open-ended sleeve member. The foldable front and rear end flaps 24*a* and 24*b* are inwardly folded about their fold lines 23 toward the open ends.

The support panel 26 has a square area and shape substantially equal to the square area and shape of the inside surface 22 of the bottom wall panel 20*d*. However, as later discussed with reference to FIG. 3, this area and shape may vary to accommodate desired configurations.

The securing mechanism 16 includes a decorative ribbon or string 17 and a plurality of apertures 32 and 34. However, the securing mechanism 16 may comprise any suitable fastening mechanism for securing distal ends of the foldable insert member 14, such as a string and button, an eyelet and hook, or snap fastener.

The foldable front attachment tab 28 is triangular although it may be any suitable shape and accommodates an element of the securing mechanism 16, namely the apertures 32 for receiving the ribbon 17. Foldable rear attachment tab 30 may also be of any suitable shape and also accommodates an element of the securing mechanism 16, namely apertures 34, also for receiving the ribbon 17.

Referring again to FIG. 1, the container device 10 is depicted with the foldable insert member 14 inserted proximate the inside surface 22 of the bottom wall panel 20*d* of the sleeve member 12 with the support panel 26 lying against the bottom wall panel. As shown, the end flaps 28 and 30 are not yet secured. In the illustrated embodiment, the external surfaces of the sleeve member 12 and at least the end flaps 24*a* and 24*b* and attachment tabs 28 and 30 are decorated, such as by patterned surface 38, which serves in the stead of gift wrap paper. The exterior surface of the sleeve member 12 may be of a different but complimentary pattern or color from the exterior surface of the insert member 14 to provide interchangeability between other similarly sized sleeve-like members and insert members. This feature, and the simple dual securing/unsecuring feature of the securing mechanism, allows the container 10 to be used as a reusable gift wrap container.

If desired, a shoulder strap, a portion of which is indicated at 40, is secured by strap eyelets 42 to a selected wall panel of sleeve member 12 to facilitate transport of the container device 10. The shoulder strap 40 may be of any suitable strength material such as leather or colored plastic.

The sleeve member 12 may be fabricated from a single blank of cardboard or other suitable foldable but relatively rigid material using techniques known in the art. The blank is formed with fold lines defining the outer margins of the various wall panels. The foldable insert 14 is fabricated from a separate single blank having suitable dimensions and fold lines to facilitate insertion and folding as described herein.

Another embodiment of the invention (not depicted) eliminates the front and rear attachment tabs 28 and 30 of the foldable insert 14. In this embodiment, a portion of the securing mechanism 16 is adapted to the foldable front and rear end flaps 24*a* and a second portion of the securing mechanism is coupled to a wall panel such that securing occurs by tying the ribbon 17 to an aperture or button affixed (not shown) to an outside surface of the sleeve member 12.

Another embodiment of the invention includes foldable reinforcement wings 35 (shown in dotted lines in FIG. 2) extending perpendicularly from outer edges of the support panel 26 to provide additional strength to the side wall panels 20*a* and 20*c* after insertion of the insert member 14. These reinforcement wings 35 are integral with the unitary blank from which the insert member 14 is formed.

Figure 3:
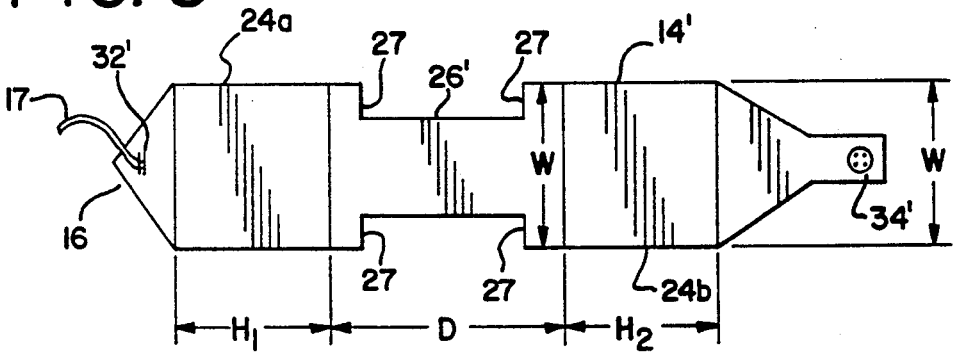
FIG. 3 is a plan view of an alternative embodiment of a foldable insert member for use in a container device similar to FIG. 1.

FIG. 3 depicts an alternative embodiment of the foldable insert member 14 wherein the support panel 26′ is configured to provide support for the front end flap 24*a* and the rear end flap 24*b* but with less material, thereby making a more economic version from that depicted in FIG. 2. Also shown is a button 34' which replaces the apertures 34 and a staple 32' which replaces aperture 32 thereby providing an alternative mechanism for securing distal ends 28 and 30 of the foldable insert 14'. Extensions 27 are of width W to provide rigidity between the front and rear end flaps 24*a* and 24*b* and the support panel 26'.

Referencing again FIGS. 1 and 2, the inventive container may be made by inserting the foldable insert member through the sleeve member from either of the two open ends 18*a* or 18*b*. The insert member is positioned such that the foldable wall panel 26 engages the inside surface of one of the interconnected wall panels such as the bottom wall panel 20*d*. Next, the contents to be packaged are inserted into the storage cavity 21 through either one of the open ends 18*a* or 18*b* of the sleeve member 12. The multiple open ends of the sleeve member 12 facilitate accessibility by allowing the contents to be guided, pushed, or pulled from opposite directions. The open ends 18*a* and 18*b* provide the maximum area through which one can grasp or view the contents. However, different configurations of the sleeve member 12 may define end openings sized to a smaller opening area, such as a configuration wherein the ends have partial covers.

After the contents are placed in the storage cavity 21 and suitably positioned, the foldable front end flap 24*a* is folded over the open front end 18*a* to cover the front opening in the sleeve member 12. Similarly, the foldable rear end flap 24*b* fold is folded over the open rear end 18*b* to cover the rear opening. The front attachment tab 28 and the rear attachment tab 30 are gathered about the outside of the sleeve-like member 12 (over the top of the sleeve-like member 12) whereafter the apertures 32 and the apertures 34 are aligned. The ribbon 17 is then used to secure the attachment tabs together about the outside of the member 12.

In the illustrated embodiment, the ribbon or string 17 is inserted through the apertures and tied so that the distal ends of the foldable insert member 14 are secured to each other. To remove the contents without damaging the container 10 or contents therein, the above steps are simply repeated in opposite order.

The two piece container 10, having been fabricated with foldable partitions, a decorative patterned exterior, and a reversible securing mechanism, may be reused as a gift wrap container or other usable container thereby reducing waste. Further, the container may be fabricated simply, using two blanks of decorative cardboard each of which requires minimal folding. The container device 10 eliminates the need for interwoven ribbons through the wall panels of the sleeve member 12 or foldable insert 14.

Figure 4:
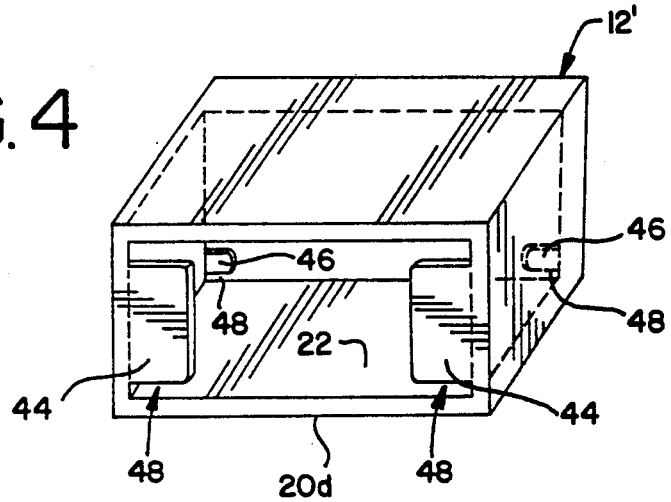
FIG. 4 is a perspective view illustrating another embodiment of a sleeve-like member for use in the container device of the type in FIG. 1.

FIG. 4 depicts a sleeve member 12' similar to sleeve member 12 but further includes foldable front tabs 44 and foldable rear tabs 46 which serve as both structural support for front and rear wall panels 24*a* and 24*b*, respectively, of insert member 14 (FIGS. 1 and 2) and also serve as alignment mechanisms such that the foldable insert member 14 may slide underneath the tabs in the areas indicated 48. These tabs also serve to secure the foldable insert member 14 against the inside surface 22 of the bottom panel 20*d*. The tabs may be adjustably sized to provide the necessary support and alignment clearance as needed for a particular application.

Figure 5:
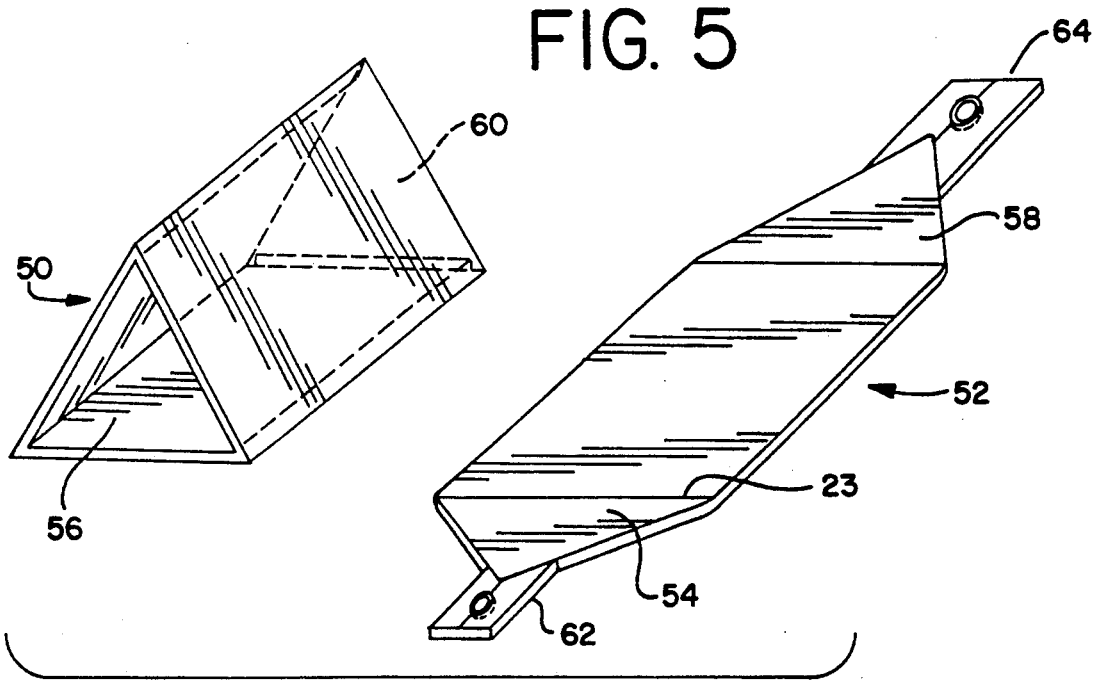
FIG. 5 is another embodiment of a sleeve-like member and accompanying foldable insert member for forming a container device in accordance with the invention.

FIG. 5 depicts another variation of a sleeve member 50 and a foldable insert member 52 used in forming a container device in accordance with the present invention. The sleeve member 50 has a triangular transverse cross section established by three interconnected side panels 50*a*, 50*b*, and 50*c*. The side panels 50*a–c* define an internal cavity open at its opposite ends 56 and 60. As with aforedescribed sleeve member 12, the foldable insert member 52 is insertable into either of the open ends 56 or 60 of the sleeve member 50. Similarly, the front end flap 54 is folded over the front open end 56 and the rear end flap 58 is folded over open rear end 60. The foldable insert member 52 is fixedly secured by attachment tabs 62 and 64 in a similar manner to the attachment tabs 28 and 30 in FIG. 2. As previously mentioned, the sleeve member 50 employed in the container device of the present invention could also be formed into other suitable shapes, such as an "L-shaped" box with two open ends to accommodate variations in content configuration. The sleeve member may also have a hexagonal transverse cross section (or other configuration whose adjacent sides are at angles greater than 90 degrees) with corresponding foldable insert member having front and rear end panels having similar hexagonal shapes.

While embodiments of container devices in accordance with the present invention have been described as finding particular application in gift wrapping items, the container devices can also be used as containers for other objects. Furthermore, suitable modifications can be made to the disclosed invention to suit a particular application. For example, the thicknesses T1 or T2 of the cardboard may be any suitable thickness depending on the expected weight or size of the contents. Also, the shape of the attachment tabs may be designed to replicate tied bows to enhance the aesthetic appeal of the container. Other variations may be implemented without departing from the true spirit and scope of the invention.

What I claim is:

1. A container comprising, in combination, a sleeve-like member having a plurality of interconnected wall panels defining an interior storage cavity having two open ends, a foldable insert member adapted to be inserted through the storage cavity from at least one of the open ends and foldably divided into a support panel and a plurality of foldable end flaps, the support panel being interposed between the foldable end flaps and adapted to lie against an inside surface of a selected wall panel, the end flaps being foldable to substantially cover the open ends, and means coupled to the foldable insert member for securing the end flaps over the two open ends to form a substantially closed enclosure about the storage cavity.

2. The container of claim 1 wherein the sleeve-like member is comprised of a unitary cardboard blank divided by a plurality of fold creases into a plurality of adjacent wall panel portions comprising the plurality of interconnected wall panels.

3. The container of claim 1 wherein the insert member is comprised of a unitary cardboard blank divided by a plurality of fold lines defining the support panel and end flaps.

4. The container of claim 1 wherein the open ends of the interior storage cavity are at opposite ends of the sleeve-like member.

5. The container of claim 1 wherein the sleeve-like member comprises a four-sided rectangular sleeve.

6. The container of claim 1 wherein the insert member further comprises a plurality of foldable attachment tabs coupled to distal edges of each of the end flaps.

7. The container of claim 6 wherein the securing means is coupled to the attachment tabs.

8. The container of claim 6 wherein the pair of foldable attachment tabs are secured to each other by the securing means to form the enclosure.

9. The container of claim 6 wherein the securing means couples both attachment tabs to an outer surface of the sleeve-like member.

10. The container of claim 1 wherein the sleeve-like member and the insert member have decorative external surfaces.

11. The container of claim 1 wherein the securing means comprises a button around which string is wrapped.

12. The container of claim 1 wherein the securing means comprises an aperture through which a tying mechanism is secured.

13. The container of claim 1 including a shoulder strap affixed to an outside surface of at least one of the wall panels.

14. The container of claim 1 wherein the sleeve-like member has a plurality of foldable tabs extending from a wall panel proximate at least one of the two open ends for providing structural support for the foldable insert member after insertion.

15. The container of claim 14 wherein the tabs are positioned proximate the inside surface of the selected wall panel to guide the insert member between the inside surface and a marginal edge of the tab when the insert member is inserted through the storage cavity.

16. A container comprising: a unitary member defined by at least a bottom wall panel, a top wall panel opposite the bottom wall panel, and a plurality of side wall panels interconnected with the top and bottom wall panels to form an interior storage cavity having two opposite open ends, a foldable unitary insert member adapted to be inserted through the storage cavity from at least one of the open ends and divided into a support panel, a pair of foldable end flaps and a plurality of attachment tabs, the support panel interposed between the end flaps and adapted to lie against an inside surface of one of the wall panels, the end flaps being foldable to substantially cover the opposite open ends, and the plurality of foldable attachment tabs, coupled to distal edges of each of the end flaps, and means coupled to the at least one of the attachment tabs for securing the plurality of end flaps over the two opposite open ends to form a substantially closed enclosure about the storage cavity.

17. A method for making a container having a sleeve-like member formed by a plurality of interconnected wall panels defining an interior storage cavity having open ends, a foldable insert member adapted to be inserted through the storage cavity from at least one of the open ends and divided into a support panel and a plurality of foldable end flaps, the support panel being interposed between the end flaps and adapted to lie against an inside surface of a selected wall panel, the plurality of end flaps being foldable to substantially cover the open ends, and means coupled to the foldable insert member for securing the plurality of end flaps over the open ends to form a substantially closed enclosure about the storage cavity, the method comprising:

inserting the foldable insert member through the sleeve-like member from either of the open ends of the storage cavity such that the foldable insert member is proximate an inside surface of one of the interconnected wall panels;

inserting contents to be packaged into the storage cavity through one of the open ends of the sleeve-like member;

folding the plurality of end flaps over the two open ends; and securing the pair of end flaps over the two open ends using the means for securing.

* * * * *